United States Patent [19]

Parks

[11] Patent Number: 4,586,359

[45] Date of Patent: May 6, 1986

[54] ANCHOR ELEMENT POSITIONER APPARATUS FOR AUTOMOBILE BODY REPAIR AND REALIGNMENT

[76] Inventor: Thomas K. Parks, 3712 N. 39th St., Tacoma, Wash. 98407

[21] Appl. No.: 739,766

[22] Filed: Jun. 3, 1985

Related U.S. Application Data

[63] Continuation of Ser. No. 546,912, Oct. 31, 1983, abandoned.

[51] Int. Cl.[4] ..... B21D 1/12

[52] U.S. Cl. ..... 72/302; 72/447; 72/705; 269/71

[58] Field of Search ..... 72/447, 705, 301, 302; 254/84, 85; 269/71, 73

[56] References Cited

U.S. PATENT DOCUMENTS

| | | | |
|---|---|---|---|
| 752,218 | 2/1904 | Galloway, Jr. | 254/99 |
| 1,002,741 | 9/1911 | Nelson | 254/99 |
| 1,106,009 | 8/1914 | Snider | 254/99 |
| 1,570,756 | 1/1926 | Magie | 254/99 |
| 2,042,856 | 6/1936 | Merrill | 72/705 |
| 2,502,037 | 3/1950 | Erikainen | 254/1 |
| 2,522,167 | 9/1950 | Englehart | 72/705 |
| 2,542,836 | 2/1951 | Porter et al. | 29/288 |
| 2,559,250 | 7/1951 | Jackson | 72/705 |
| 2,717,020 | 9/1955 | Dobias | 72/705 |
| 3,091,278 | 5/1963 | Padgett | 72/705 |
| 3,493,209 | 2/1970 | Brammer | 248/352 |
| 3,921,433 | 11/1975 | Whitney | 72/705 |
| 4,023,394 | 5/1977 | Borup | 72/457 |
| 4,037,831 | 7/1977 | Johnson | 269/306 |
| 4,088,002 | 5/1978 | Andrew | 72/389 |
| 4,099,707 | 7/1978 | Anderson | 254/35 |
| 4,201,076 | 5/1980 | Jarman et al. | 72/392 |
| 4,296,626 | 10/1981 | Jarman et al. | 72/392 |
| 4,344,314 | 8/1982 | Aldrich et al. | 72/705 |
| 4,404,838 | 9/1983 | Hare | 72/705 |
| 4,463,937 | 8/1984 | Celette | 72/705 |
| 4,519,236 | 5/1985 | Celette | 72/705 |

FOREIGN PATENT DOCUMENTS

| | | | |
|---|---|---|---|
| 249933 | 10/1963 | Australia | 72/705 |
| 16745 | 2/1977 | Japan | 72/705 |

OTHER PUBLICATIONS

International application published under PCT, WO83/03373 Applicant-Westfeldt et al.; pub. date-Oct. 13, 1983.

*Primary Examiner*—Lowell A. Larson

*Attorney, Agent, or Firm*—Christensen, O'Connor, Johnson & Kindness

[57] ABSTRACT

Unitized automobile body repair apparatus comprising an arch frame with repositioners thereon connectable to opposite McPherson strut heads or other anchor elements to move the same by three-way screwjack action in any one or more of three lines of motion in either direction so as to reposition and hold such anchor elements. Cooperating with the repositioners are body side edge, flange-engaging, repositioning and holder jacks, beam-mounted for selective positioning on a floor frame carrying the vehicle.

17 Claims, 9 Drawing Figures

Fig. 2.
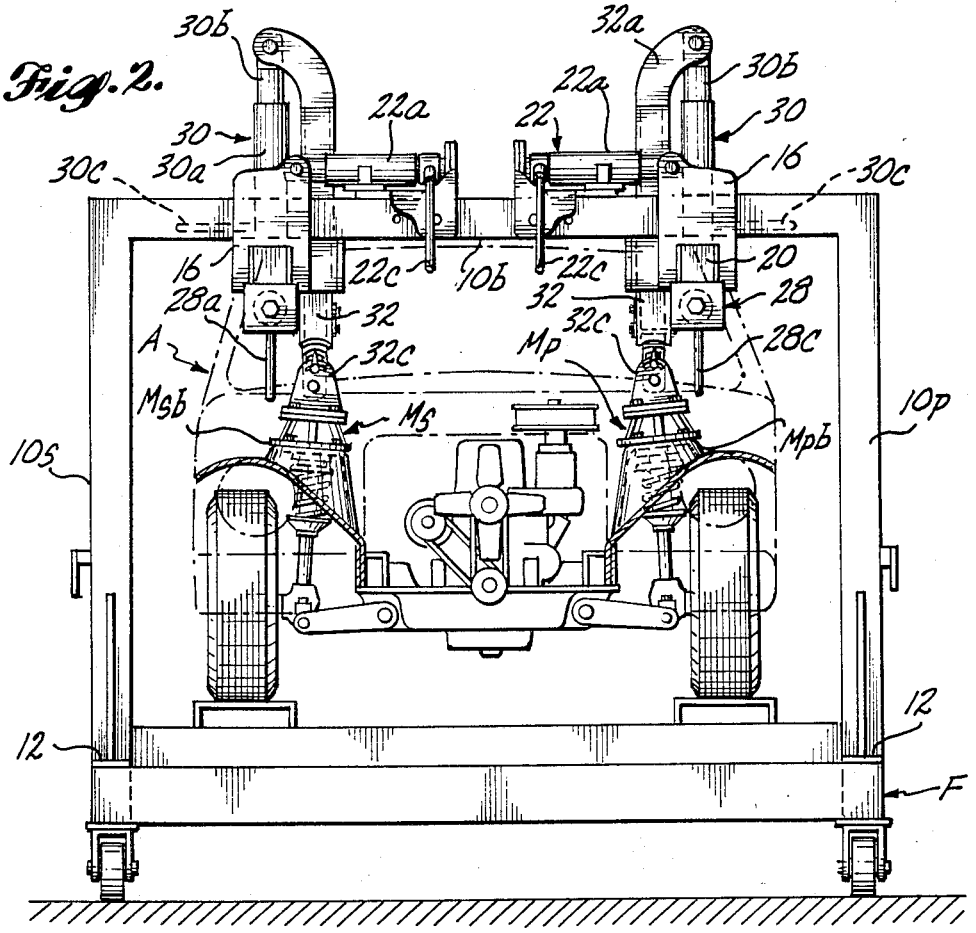
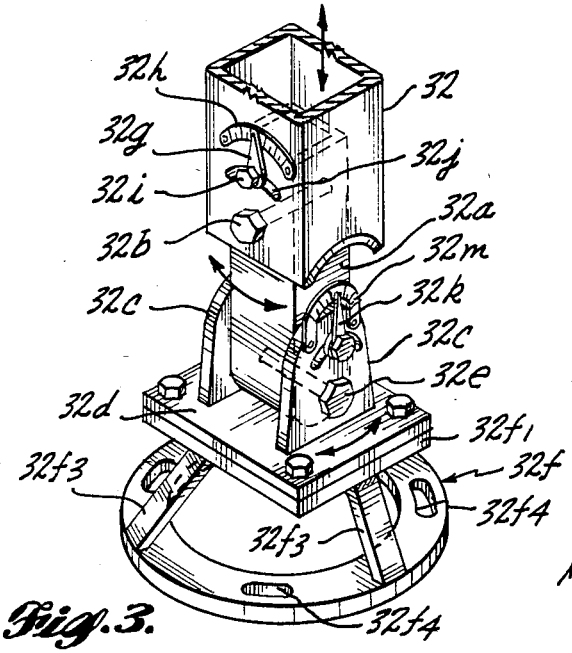
Fig. 3.
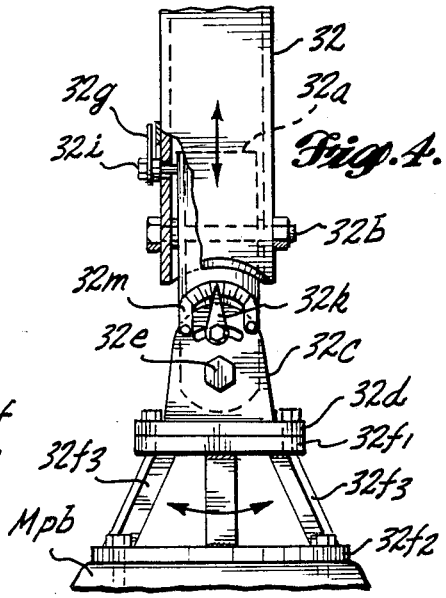
Fig. 4.

Fig. 7.
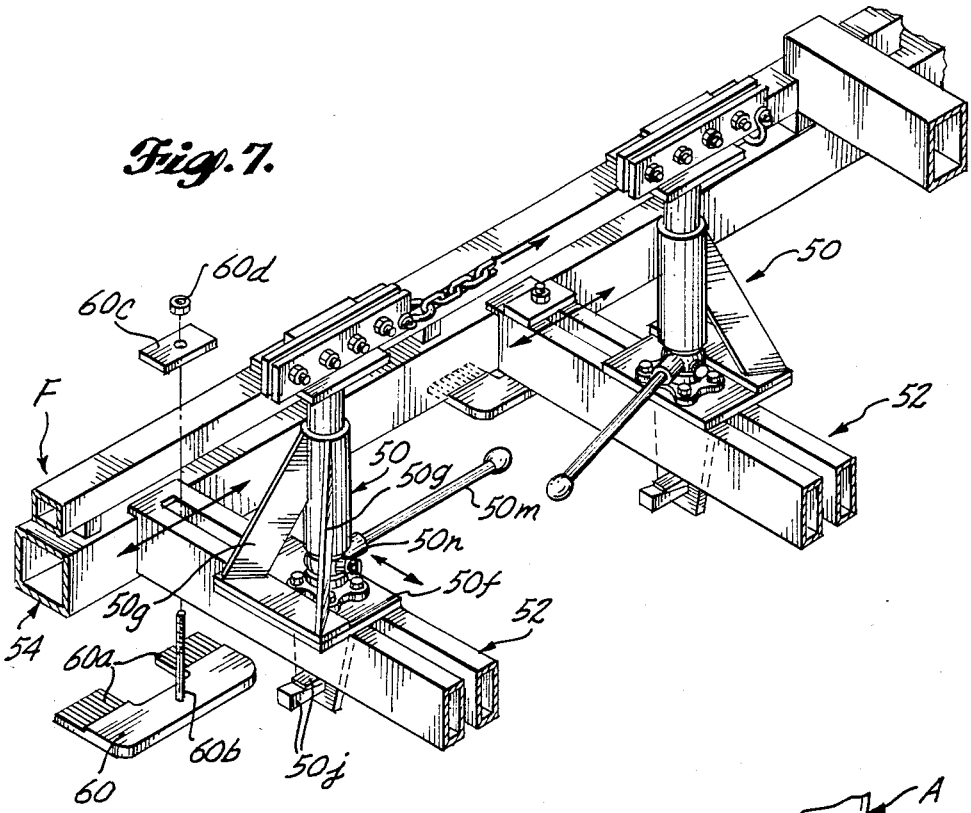
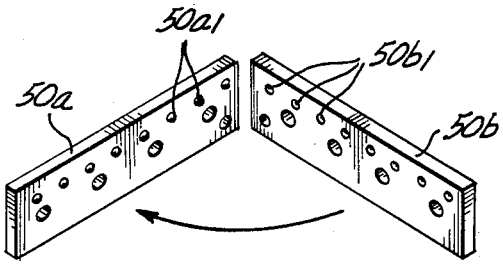
Fig. 8.
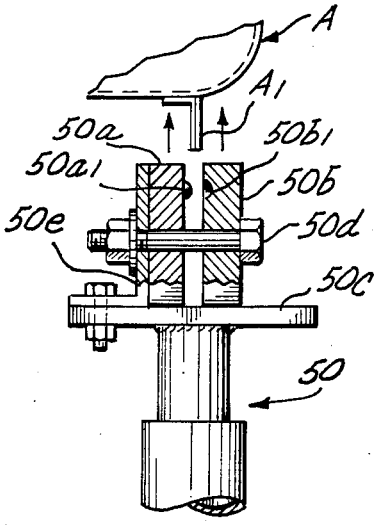
Fig. 9.

ANCHOR ELEMENT POSITIONER APPARATUS FOR AUTOMOBILE BODY REPAIR AND REALIGNMENT

This application is a continuation application based on prior copending application Ser. No. 546,912, filed Oct. 31, 1983, abandoned, ANCHOR ELEMENT POSITIONER APPARATUS FOR AUTOMOBILE BODY REPAIR AND REALIGNMENT.

BACKGROUND OF THE INVENTION

This invention relates to improvements in apparatus for repairing damaged automobile bodies, particularly those of the current monocoque or unitized sheet metal construction in which the former assembly of moldings and parts mounted on a structural skeletal base frame is replaced by unitized sheet metal subassemblies joined together by welding and/or bolting so as to support each other structurally.

In current practice, static and dynamic load transfer between the unitized sheet metal body assemblage and undercarriage wheel mounts occurs through load transfer members. These of necessity then become primary anchor points and positional references in repairing body damage after an accident. In most currently produced vehicle bodies, these positional references at the front end of the vehicle comprise the upper end mounts or heads of the two McPherson struts respectively positioned at opposite sides of the vehicle. The present invention relates to a new and improved repair apparatus for restoring the McPherson strut heads or equivalent to the correct positional relationship for body and wheel realignment. A further objective is to provide a versatile device for this purpose adapted to function with any of different commercially available repair shop beam-and-rail floor frames upon which vehicles under repair are mounted and by which basic fixed positional referencing of the body structure as a whole is maintained during repair procedures.

In autobody repair shops over the years, various floor frame structures have been used to mount and hold automobile bodies in fixed reference position. An assortment of jacks, chain-pulls and winches, along with various clamps and locks attachable to the holder frame, have been necessary in applying the forces and combinations of forces required to restore basic positioning and alignment of body points. Most of the commonly used equipment required substantial time and labor in making and using a number of setups in procedural sequences in order to apply the necessary forces and combinations of forces to each reference point. Not infrequently, repetitious alternating setups were necessary in order to go through a succession of positional approximations of each of two or more body parts as a means of achieving the desired positional relationship between them. These were expensive procedures both in terms of equipment requirements and especially in terms of labor costs. Moreover, in repairing unitized automobile bodies made principally of thin sheet metal, such former equipment and procedures presented special and further difficulties. With such vehicles, retention of body/frame strength in the repaired state, particularly with body repairs requiring repeated restorative bendings of the sheet metal through major angular ranges (often to remove accordioned or crumpled areas) depends critically upon avoidance of metal fatigue. The present invention provides precisional positioning of basic body/frame points and sections in a single setup and in a one-time application of the interrelated directional repositioning forces applied to the body anchor elements, and stably holds their positionings during related subsequent force applications to other portions of the body.

A further object is to provide such repair apparatus of efficient, economical design, which can be quickly set up and applied, and one which is relatively easy to use.

Still, another object is to provide such apparatus having versatility in its application to assorted types of frame damage.

A further object hereof is to achieve those purposes in apparatus incorporating compactly its own essential force applicators and frame support means therefor, and thereby minimizing the necessity of storing and of taking the time to set up and return to storage a number of separate force applicators and attachments each time a new job, or a step in a sequence of steps of a job, is to be done, and after a job is completed.

A related object is to provide such apparatus adapted for installation on existing basic automobile floor frames or holder platforms so as to minimize initial capital cost to the body repair shop.

SUMMARY OF THE INVENTION

The invention, herein illustratively described in its presently preferred form, resides in the concept of dividing a rigid arch frame comprising a generally horizontal cross beam extending between and structurally joining upstanding legs or posts having feet anchored to the respective opposite sides or rails of a floor frame of the one or more types commercially in use by automobile body repair shops. This arch frame carries a pair of tri-plane repositioners mounted on the cross member in positions mutually spaced lengthwise of the cross beam so as to overlie and address each of the two McPherson strut heads or equivalent automobile body realignment anchor points or reference elements. The McPherson strut heads represent typical anchor points or elements, the positioning and orientation of which in relation to each other and to the remainder of the automobile body are critical to body realignment after an accident affecting their positions and orientation. Once these elements are correctively repositioned and oriented, they must be held against further movement as conjunctive operations are applied to stretch, bend and otherwise reshape other parts of the unitized body structure in relation to them. They also, of course, affect wheel alignment including caster, camber and toe-in defined by the McPherson strut assemblies and their body mounts.

In further accordance with this invention, each repositioner in its disclosed form comprises first, second and third reversible-acting linear motion screwjacks along with first, second and third base members, with the first base member being mounted on the cross beam and preferably adjustably positioned lengthwise thereof, and with the second base member being slidably mounted on the cross beam to be moved lengthwise thereof by a first selectively reversible screwjack overlying the cross beam. The second base member, thereby movable lengthwise of the cross beam, in turn, carries a generally horizontal beam member preferably in the form of a cantilever beam projecting generally horizontally at right angles from the cross beam and, in turn, carrying the third base member. The third base member is moved in relation to the second base member by a second screwjack interconnecting the two members and preferably underlying and extending lengthwise of the cantilever beam member. Actuation of the second screwjack moves the third base member into any of different selected positions lengthwise of the cantilever beam member.

The third base member in its turn carries a second beam member, preferably also in the form of a cantilever forcibly movable upwardly and downwardly by a third screwjack. The third screwjack in the illustrated embodiment stands upwardly on the third base member where it is connected to the last-mentioned beam member.

The last-mentioned beam member comprises a force applicator carrying on its lower end a coupling means with an adjustably oriented coupler element engageably connectable to the strut head or other positional reference element in the automobile body. The angularity of the adjustably oriented coupler element is registered on indicator means in each of two planes as a means of determining necessary repositioning of the latter during the overall realignment process.

The composite apparatus permits precise selective repositioning of the McPherson strut heads in either direction of movement, respectively, along any of three mutually transverse lines of movement or adjustment. This it does by selective operation of the respective screwjacks. The latter may be incorporated in the beam members, or preferably, as shown, may provide as separate elements external to, but extending along, such beam members. In the preferred form, each such screwjack is operated by a manually reciprocated lever arm accessible to the repair shop worker and an associated jack ratchet control which may be reversed at will in order to apply one direction of swing of the operating arm to achieve forcible extension of the jack, or the opposite direction of swing to achieve forcible retraction of the jack. A pair of such mechanisms in a single setup will suffice to accomplish the full repositioning of both McPherson strut heads merely by using ordinary experienced judgment in the sequence and progression of movements along the three direction lines of the interrelated screwjacks. The final position and orientation of each McPherson strut head is thus achieved by a gradual approach with little or no risk of overshooting or exceeding the final position sought, and thereby with minimum fatiguing of the metal. Built into the same mechanism is the inherent capability of not only positioning the two strut heads in relation to each other using the two balanced repositioners making up a pair mounted on the same fixed cross beam of the arch frame, but also in repositioning those strut mounts in relation to the vehicle body. In accordance with still another feature, the body is stably held in fixed relationship to the floor frame by sets of lower side edge runner flange holder jacks which themselves are relatively positionable lengthwise and crosswise of the floor frame in realigning those flanges as basis to body alignment and position on the floor frame.

These and other features, objects and advantages of the invention will become more fully evident as the description proceeds by reference to the accompanying drawings.

DESCRIPTION OF THE DRAWINGS

FIG. 2 is a front end view of the apparatus, automobile and floor frame shown in FIG. 1.

FIGS. 3 and 4 are, respectively, a top perspective view and a front elevation view of coupler means by which the force actuator (vertically movable cantilever beam) is coupled to the upper end of a McPherson strut head or equivalent.

FIG. 7 is a top perspective view of a portion of the floor frame taken from an aspect between the opposite sides of the floor frame and partially toward one end thereof illustrating a cooperating pair of holder jacks and the means by which they are movably positioned both lengthwise and transversely of the floor frame.

FIGS. 8 and 9 illustrate a preferred clamping means by which the lower runner flanges along the opposite sides of an automobile body are gripped and held, without damage, by the head end of the holder jacks illustrated, for example, in FIG. 7.

DETAILED DESCRIPTION REFERRING TO DRAWINGS

Figure 1:
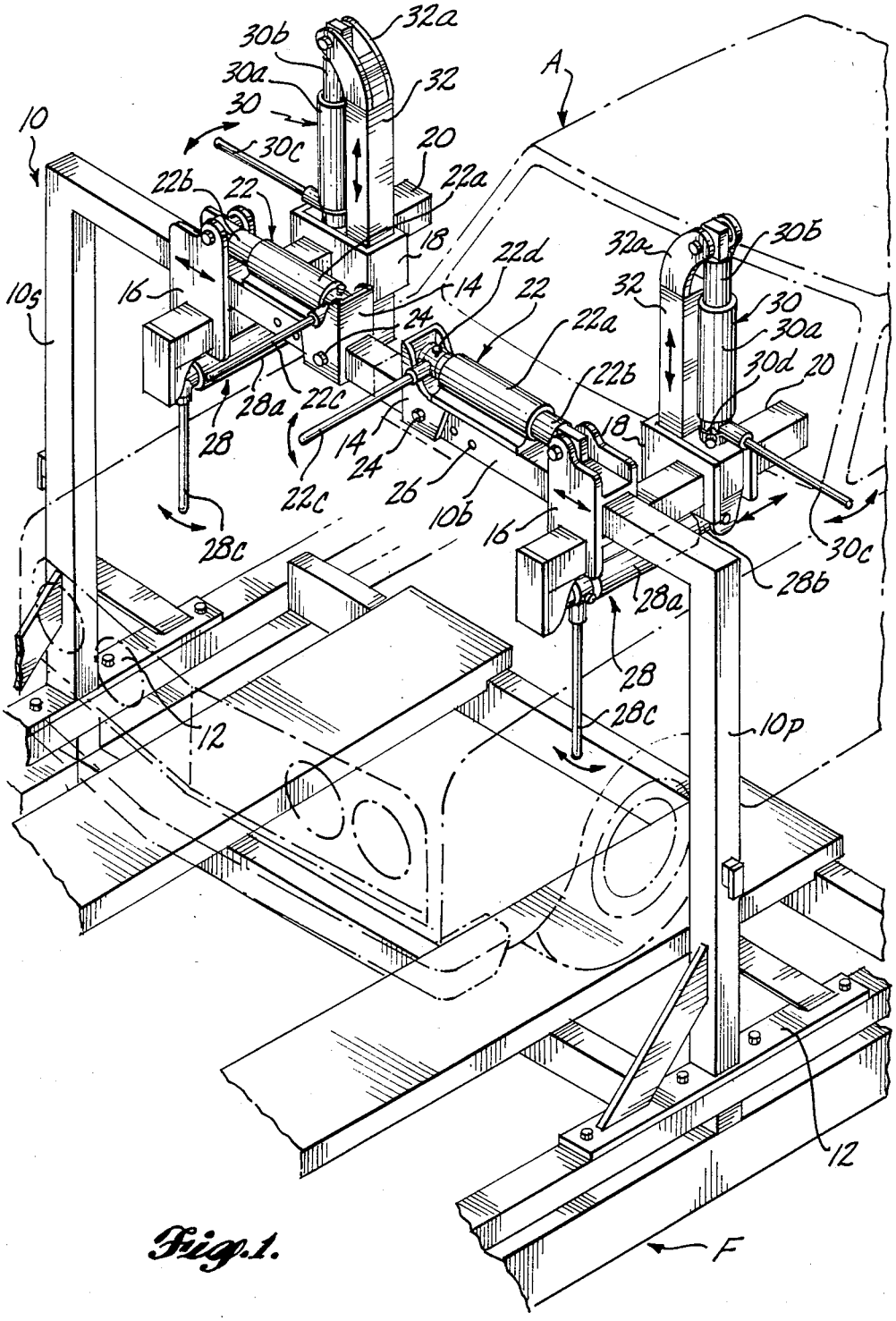
FIG. 1 is a top perspective view of the apparatus shown installed on a floor frame fragmentarily illustrated in the view for application to a damaged automobile shown in phantom supported on the floor frame and within the operational field of the repair apparatus of this invention.
Figure 5:
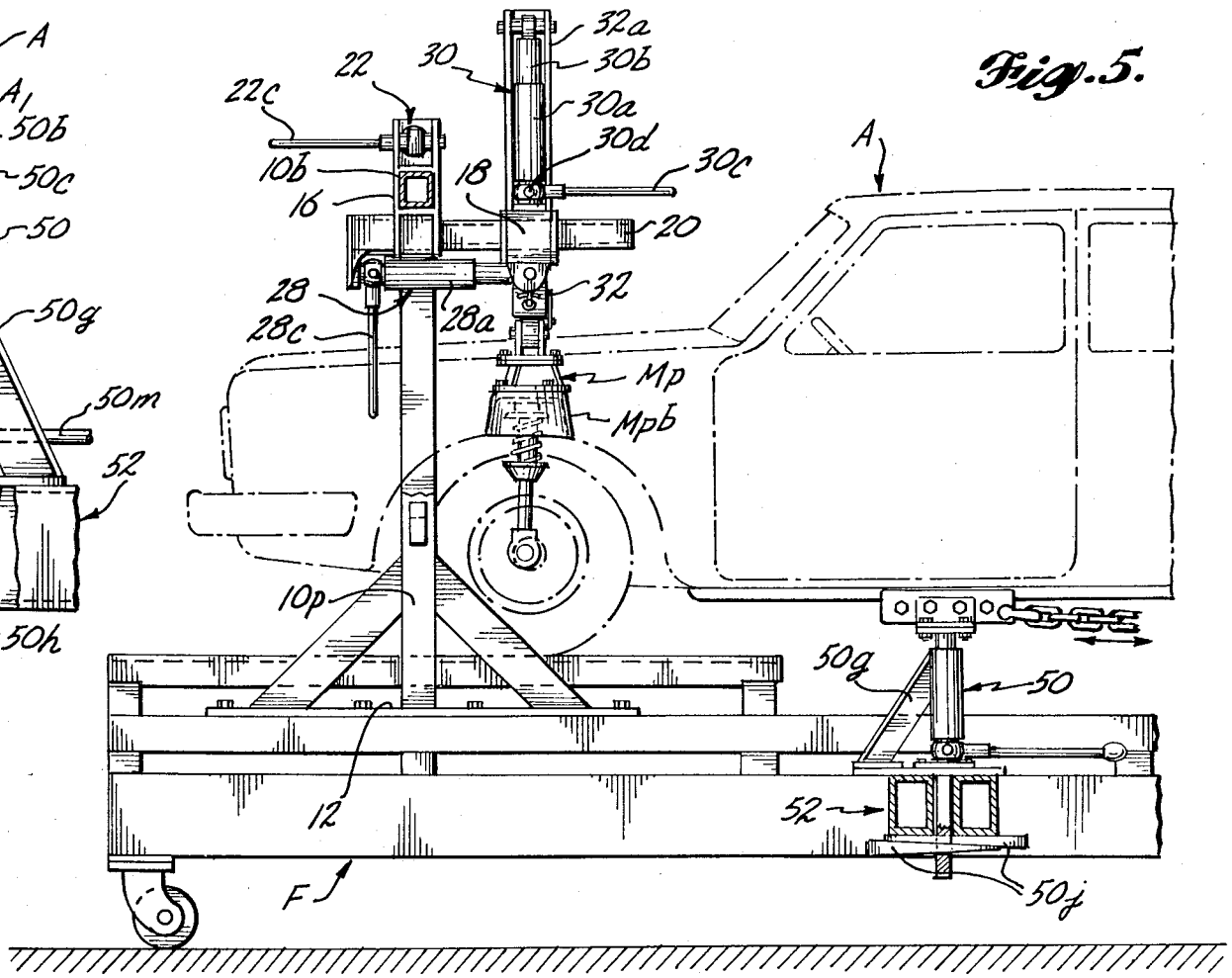
FIG. 5 is a side view of the apparatus depicted in FIG. 1 and also illustrating one of the body positioner runner flange holder jacks of a pair typically employed on each side of the automobile in order to position the lower opposite side edge flanges of the vehicle body in fixed relation to the floor frame.
Figure 6:
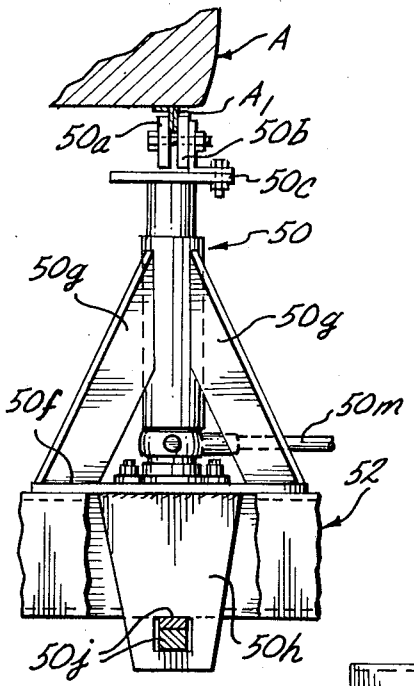
FIG. 6 is a view taken at right angles to the view of the jack shown in FIG. 5 and illustrating further details of the holder jacks, including the means by which it is mounted on the floor frame.

Referring to the drawings, floor frame F may be of any suitable type of which there are different ones available at the present time, usually including longitudinal rails upon which may be securely mounted, by bolts or otherwise, the braced feet 12 which support upright legs or posts 10*p* and 10*s* of arch frame 10. Arch frame 10 further comprises an elongated straight cross beam 10*b* extending generally horizontally between and interconnecting the legs 10*d* and 10*s*. The cross beam 10*b* is positioned transversely to the length of an automobile A resting upon and fixed in relation to the floor frame F by suitable means such as that to be described. In the principal application of the invention, and as shown best in FIGS. 2 and 5, the cross beam 10*b* overlies and spans across the automobile body and particularly the opposed McPherson struts $M_sM_p$ therein, the heads of which are to serve as the anchor points in the automobile body repair operation. These strut heads, $M_{pb}$ and $M_{sb}$, have essential relative positions and orientations or slope angles transversely of the automobile body and lengthwise thereof, critical to alignment and repair operations applied to the automobile body. Engageable with these strut heads are the force applicator coupler means (shown in FIGS. 3 and 4) of the repositioners as will be more fully described. In essence, the basic function of the repositioners is to provide repositioning forces to these strut heads through the coupling means in any of three mutually perpendicular lines of repositioning movement (such as horizontally both lengthwise and crosswise of the vehicle, and vertically) and to maintain their re-established positions securely and without creep during subsequent repair operations on the body.

To accomplish the application of forced repositioning movements of the strut heads in each and all of the three lines of motion and in either direction along such lines, each repositioner comprises a first base member 14 movable along the cross beam 10*b* into any of different selected positions and held there by a fastener bolt secured in any of a series of fastener holes 26 spaced along the length of the cross beam. A second base member 16 is slidably mounted on the cross beam between the base member 14 and one end of the cross beam and is forcibly movable lengthwise of the cross beam by a selectively reversible screw-type jack 22 comprising a cylindrical jack body 22*a* and extensible linear motion jack piston or rod 22*b*, one of which is coupled to the base member 14 and the other to the base member 16 as shown. A manual operating handle 22*c* which may be swung back and forth about the longitudinal axis of the jack 22 effects either extension or retraction of the jack piston 22*b* depending upon the reversible setting of ratchet control 22*d*. Such reversible screwjacks, as such, have been commercially available for some years.

Cross beam 10*b*, preferably of square or other flat-sided construction, is snugly, although slidably, nonrotationally engaged by the second base member 16, thereby to enable the latter to serve as a mounting base for a second beam which is the cantilever beam 20 projecting generally horizontally and transversely to the cross beam 10*b* and in turn carrying a third base member 18 slidable lengthwise of cantilever beam 20. A second screw-type reversible jack 28 similar to the jack 22 and including a cylindrical body 28*a* and extensible piston 28*b* has its opposite end connectors fastened respectively to the base members 16 and 18 which carry the jack at a location preferably underlying the cantilever beam 20 and also the cross beam 10*b*. The manual operating lever 28*c* of the jack 28 preferably is located beneath the cross beam 10*b* where it is out of the way of the force applicator to be described including its coupler means for reasons which will become apparent. Thus, operation of the jack 28 to move the third base member 18 along cantilever beam 20 may be selected so as to move such base member forcibly either toward or from the cross beam 10*b* in directions forward or aft, hence lengthwise of the automobile body to be repaired.

Cross beam 20 is preferably also of rectangular or flat-sided construction for the same reason that cross beam 10*b* is of such construction, namely, in this latter instance, to provide a snug but sliding nonrotational engagement between the cantilever beam 20 and the base member 18. Thus, the base member 18 can and does serve as a rigid, nonrotating support for a vertically movable second cantilever beam 32 in the form of an elongated bar-like member snugly received and slidable lengthwise (up and down) in a receiving aperture in base member 18. Bar-like member 32 is of a length to project both above and below the base member 18. Its lower end, as depicted in FIGS. 3 and 4, carries the coupler means mentioned, whereas its upper end projecting above the base member 18 has a clevis 32*a* by which it is coupled to the extensible piston 30*b* of a third reversible screw-type jack 30. The lower end of jack body 30*a* standing upon the base member 18 carries a manual actuation lever 30*c* and a selectively reversible ratchet head 30*d* as in jacks 22 and 28. In this instance, operating lever 30*c* is reciprocable about a vertical axis and preferably lies in a position extending outboard (of the vehicle) from cantilever beam 20.

Referring to FIGS. 3 and 4, the coupling means by which force applicator beam 32 is to move the strut heads $M_{sb}$ $M_{pb}$ under force, either upwardly or downwardly, includes a relatively short bar-like member, such as a short length of hollow rectangular tubing 32*a*, secured in the lower end of member 32 by a first pivot bolt or pin 32*b* passing through both and permitting limited swinging or pivoting of the member 32*a* about the axis of such bolt, the outside cross-sectional dimension of member 32*a* being sufficiently smaller than the inside corresponding cross-sectional dimension of member 32 transversely to the bolt 32*b* as to permit such limited pivotal movement. The lower end of member 32*a* is pivotally mounted between lugs 32*c* upstanding from a flat, coupler plate 32*d*, the pivotal connection in that instance comprising the pivot bolt 32*e* passed through the lugs and the member 32*a* in a horizontal plane. The bolts 32*e* and 32*b* lie in mutually transverse upright planes axial to the member 32. A coupler 32*f* bolted or otherwise secured to the plate 32*b* is shown as comprising a companion plate 32*f*1, and, beneath and parallel to the plate 32*f*1, an annular band 32*f*2 structurally positioned by means of four struts 32*f*3 spaced in quadrature and diverging relatively from the plate 32*f*1 to the annular plate 32*f*2 as shown. Annular plate 32*f*2 has circumferentially spaced arcuate slots 32*f*4 by which to bolt the same to the McPherson strut head or other reference element in the automobile body. Other couplers than that shown as 32*f* may be provided if desired, depending upon the particular application and the element to which the force applicator of the invention must be connected.

In order to determine with the necessary degree of precision the angularity of the McPherson strut head to which the coupler member 32*f* is bolted at any point during the repair procedure, two angle indicators are conveniently provided in the coupler means. The angle to be indicated in each instance is the pivot angle about the axis of bolt 32*b* and separately the pivot angle about the axis of bolt 32*e*. This is simply accomplished in the first instance by securing a pointer 32*g* to the member 32*a* to register with an arcuate scale 32*h* centered on the axis of bolt 32*b*. To this end, pointer 32*g* is secured by bolt 32*i* to the member 32*a* through an arcuate slot 32*j* accommodating swinging of bolt 32*i* about the axis of bolt 32*b*. Similarly, a pointer 32*k* bolted to the member 32*a* to register with a scale 32*m* on the side of one lug 32*c* indicates the pivot angle of member 32*a* about the axis of bolt 32*e*.

In setting up the apparatus initially, coupler ring 32*f* is brought into position bodily and is tilted the necessary amount to be bolted flat against the McPherson strut head. This enables the operator to view the angularity of the strut head as registered by the indicators about the axes of bolts 32*b* and 32*e*, respectively. For a given vehicle, with member 32 precisely upright in relation to the lower frame, these indicators should provide specified readings if the strut head plane is correctly oriented. If it is not correctly oriented, use of tools such as pry bars, or the like, applied to the coupler 32*f*, may be used to achieve the correct angularity, at least to an initial degree of approximation. Subsequently, as those strut heads are moved bodily up or down, fore or aft or transversely one way or the other into the correct bodily positions, the same indicators may be monitored to assure maintenance of correct angularity of the strut head and to restore or position it into correct angularity as final positioning of the strut head is approached and reached.

Turning now to the positioning and holding of the lower side flange portions of the automobile body in fixed relation to the floor frame F upon which the automobile is mounted for repair, reference is made in particular to FIGS. 5–9, wherein sets of screwjacks 50 are slidably mounted on respective transverse frame beams 52 to be movable lengthwise of such beams. The beams themselves can be shifted lengthwise of the frame side rails 54 and locked in any shifted position. The positioning of each of the holder jacks 50 is initially determined so as to permit gripping and holding the runner (body side and bottom joint) flanges $A_1$ projecting downwardly from the side of the unitized automobile body between the opposing jaw plates 50*a* and 50*b* of each jack 50, with two or more such jacks spaced lengthwise or each runner flange $A_1$. Once correctly positioned in transverse registry with the flange $A_1$ by sliding of the jack 50 along the support beam 52, the support beam is then moved lengthwise of the lower frame rails 54 to be correctly stationed lengthwise of the runner flanges $A_1$, at which point the screw actuating mechanism of the jack 50 is operated to elevate the jack head 50*c* with its jaw plates separated to receive the flange $A_1$. Thereupon clamp bolts 50*d* passing through the clamp plates 50*a* and 50*b* and through a mounting flange 50*e* on jack head 50*c* are tightened to securely grip the runner flange between them. Protrusion elements 50*a*1 projecting from the inside face of clamp plate 50*a* registering with opposing recesses 50*d*1 in plate 50*b* at intervals lengthwise of the clamp plates dimple the metal of flange $A_1$ when the clamp bolts 50*d* are tightened such that, without damaging the flange $A_1$, the flange will be held very securely to the jack head 50*c*. With the flange thus engaged, force applicators may be applied to the jack head in any desired direction in order to restore the flange portion being gripped to the correct positional relationship with other portions of the vehicle body, including the portion of the flange $A_1$ gripped by the jaws of the one or more companion jacks used in the process. For example, a chain C may be used with a come-along, or possibly with a turnbuckle, to shift the jack lengthwise of the frame rail 54 in either direction, the same with respect to the companion jack.

In order to apply force to the flange $A_1$ upwardly or downwardly at the location of a jack, the jack itself is used and for this purpose is locked in position against vertical shifting in relation to the supporting rail 52. This is done by mounting the jack on a base plate 50*f* (suitably reinforced by angled braces 50*g*) with a stabilizer web plate 50*h* projecting downwardly through a slot in rail 52 and secured at its protruding lower end by opposed transversely driven wedges 50*j* driven through an aperture in web plate 50*h* at the bottom level of the beam 52. Thus, actuation of the jack 50 through swinging of its actuator arm 50*m* back and forth with further reversing ratchet 50*n* properly set can be used to forcibly raise or to forcibly lower the automobile body runner flange $A_1$ gripped by that jack.

With a beam 52 finally located in the desired position lengthwise of floor frame rail 54 where it is to remain during subsequent operations, it may be locked in such a position by means of a shoeplate 60 having serrated tread surfaces 60*a* pressed against the underside of the rail 54, and with a clamp bolt 60*b* projecting upwardly towards the slot in the cross beam 52 to be capped by an upper clamp plate 60*c* and tightener nut 60*d* to secure the beam end in position along the rail 54.

There are numerous possible variations in construction of base supports and associated means by which the arch frame and positioners may be mounted in association with means for holding the remainder of the vehicle body in fixed position, and it is the intention of the claims which follow to cover modifications and variations of the subject matter defined. To that end, the illustrated embodiment and equivalents thereof are intended to be considered within the scope of such claims.

The embodiments of the invention in which an exclusive property or privilege is claimed are defined as followed:

1. Automobile body repair apparatus comprising a rigid arch frame having a generally horizontal cross beam structurally joining upstanding legs adapted to be anchored to a floor frame or equivalent so as to span transversely over opposed body realignment reference elements such as McPherson strut heads of the automobile fixedly seated on said floor frame; a pair of repositioners mounted on said cross beam in positions mutually spaced lengthwise thereof, each such repositioner comprising:

first, second and third reversible-acting linear motion screwjacks;

first, second and third base members;

said first base member being mounted on said cross beam, with means to fix the position thereof lengthwise of said cross beam;

said second base member being slidably mounted on said cross beam to be moved slidably lengthwise thereof;

said first and second base members carrying between them, and being interconnected by, said first screwjack for forcible repositioning of said second base member lengthwise of said cross beam in either direction by operation of said first screwjack;

a generally horizontal beam member carrying said third base member and in turn being carried by said second base member to extend transversely in relation to said cross beam;

said second and third base members carrying between them, and being interconnected by, said second screwjack for forcible repositioning of said third base member lengthwise of said horizontal beam member in either direction by operation of said second screwjack;

said third screwjack being carried by said third base member; and force applicator means carried by said third base member and including an elongated first cantilever member mounted to extend downwardly from said third base member and to be forcibly movable upwardly and downwardly by operation of said third screwjack, said force applicator means including coupler means by which to connect the same to the body realignment reference element, thereby to permit forcible repositioning of said latter element in either direction of movement respectively along any of three mutually transverse lines of movement by selective operation of the screwjacks.

2. The apparatus defined in claim 1, wherein the first cantilever member is separate from the third screwjack.

3. The apparatus defined in claim 2, wherein the first cantilever member comprises an elongated bar-like member slidably mounted in the third base member with a portion extending above the third base member and a portion extending below the third base member, and with the coupler means mounted on the lower end of said bar-like member.

4. The apparatus defined in claim 3, wherein the third screwjack stands upwardly upon the third base member and includes a linearly extensible and retractable jack element coupled to the upper end of the bar-like member.

5. The apparatus defined in any of claims 1–4, wherein the generally horizontal beam member comprises a bar-like member mounted on the second base member and projecting therefrom as a cantilever transversely in relation to the cross beam.

6. The apparatus defined in claim 5, wherein the second and third base members have elements projecting downwardly therefrom to a level beneath the horizontal beam member and wherein the second screwjack has opposite ends respectively connected to said elements at a level below said horizontal beam member and extending parallel to said horizontal beam member.

7. The apparatus defined in claim 5, wherein the first and second base members have elements lying above the cross beam and wherein the first screwjack has opposite ends connected to the respective elements and itself lies above said cross beam to extend lengthwise thereof.

8. The apparatus defined in claim 5, wherein the second and third base members have elements projecting downwardly therefrom to a level beneath the horizontal beam member and wherein the second screwjack has opposite ends respectively connected to said elements at a level below said horizontal beam member and extending parallel to said horizontal beam member, and further wherein the first and second base members have elements lying above the cross beam and wherein the first screwjack has opposite ends connected to the respective elements and itself lies above said cross beam to extend lengthwise thereof.

9. The apparatus defined in any of claims 1–4 wherein the screwjacks are each individually operated by a lever, the lever positioned and operable to be swung back and forth manually in a plane perpendicular to the motion line of the jack.

10. The apparatus defined in claim 5, wherein the screwjacks are each individually operated by a lever, the lever positioned and operable to be swung back and forth manually in a plane perpendicular to the motion line of the jack.

11. The apparatus defined in claim 7, wherein the screwjacks are each individually operated by a lever, the lever positioned and operable to be swung back and forth manually in a plane perpendicular to the motion line of the jack.

12. The apparatus defined in claim 8, wherein the screwjacks are each individually operated by a lever, the lever positioned and operable to be swung back and forth manually in a plane perpendicular to the motion line of the jack.

13. The apparatus defined in any of claims 1–4, or 5, wherein the coupler means comprises an adjustable member adapted for rigid detachable connection to the automobile body reference element in whatever oriented position the latter has assumed in the damaged state of the automobile body.

14. The apparatus defined in claim 13, including, in physical association with the adjustable member, indicator means indicating angular position of the adjustable member relative to the force applicator means.

15. Automobile body repair apparatus comprising a first elongated rigid support beam; means for mounting the beam in fixed relation to and spanning across a portion of an automobile body to be repaired, which portion includes at least one realignment reference such as a McPherson strut head, the positioning of which in relation to the automobile body as a whole is basic to repair thereof; repositioner means mounted on said beam and including a first slidable base movable lengthwise of the beam; reversible first screw-type actuator means mounted on said beam and connected to said first slidable base for moving the same into any of different positions lengthwise of said first support beam; a secondary elongated rigid support beam mounted on said first slidable base and extending transversely to the first rigid support beam for bodily movement along said first rigid support beam by movement of said first slidable base along the latter; a second slidable base mounted on said secondary support beam for movement lengthwise thereof; second screw-type actuator means mounted on said secondary support beam extending lengthwise thereof and connected to said second slidable base to move the same lengthwise of said secondary support beam by operation of said second screw-type actuator; said first rigid support beam and said secondary support beam defining available paths of motion for said second slidable base; and force applicator means mounted on said second slidable base, said force applicator means comprising coupler means adapted for connection to said automobile body reference element, the force applicator means further comprising third screw-type actuator means interconnected between said coupler means and said second slidable base and operable to forcibly move said coupling means and thereby said automobile body reference element toward and from said secondary support beam.

16. The apparatus defined in claim 15, wherein the third screw-type actuator means comprises an elongated bar-like member slidably mounted in said second slidable base, said bar-like member having first and second ends, said first end connected to said coupling means, said screw-type actuator also comprising an elongated screwjack mounted on said second slidable base, the screwjack extending parallel to said bar-like member and operably connected to the second end of said bar-like member.

17. The apparatus defined in claims 15 or 16, wherein the first and second screw-type actuator means comprise separate reversible elongated screwjacks respectively mounted extending parallel to the first rigid support beam and the secondary support beam.

* * * * *

UNITED STATES PATENT AND TRADEMARK OFFICE

CERTIFICATE OF CORRECTION

PATENT NO. : 4,586,359

DATED : May 6, 1986

INVENTOR(S) : Thomas K. Parks

It is certified that error appears in the above-identified patent and that said Letters Patent is hereby corrected as shown below:

Column 3, Line 28, "members, or" should be --members or,--

Column 3, Line 28, after "may" insert --be--

Column 3, Line 28, "provide" should be --provided--

Column 4, Line 64, "re-established" should be --reestablished--

Column 10, Line 11, after "reference" insert --element--

Signed and Sealed this

Eighteenth Day of November, 1986

*Attest:*

DONALD J. QUIGG

*Attesting Officer* *Commissioner of Patents and Trademarks*